US006817157B2

(12) United States Patent
Bourque

(10) Patent No.: US 6,817,157 B2
(45) **Date of Patent: *Nov. 16, 2004**

(54) DECK ATTACHMENT BRACKET AND METHOD OF ATTACHING A DECK TO A BUILDING

(76) Inventor: Michael Bourque, 502 Holly Ave., Manchester, NH (US) 03103

( * ) Notice: Subject to any disclaimer, the term of this patent is extended or adjusted under 35 U.S.C. 154(b) by 0 days.

This patent is subject to a terminal disclaimer.

(21) Appl. No.: 10/145,115

(22) Filed: May 20, 2002

(65) Prior Publication Data

US 2002/0134042 A1 Sep. 26, 2002

Related U.S. Application Data

(63) Continuation of application No. 09/360,065, filed on Jul. 23, 1999, now Pat. No. 6,397,552.

(51) Int. Cl.[7] ..... E04B 1/38
(52) U.S. Cl. ..... 52/712; 52/713
(58) Field of Search ..... 52/712, 713, 745.06, 52/745.21, 702, 714, 506.7, 293.3, 289

(56) References Cited

U.S. PATENT DOCUMENTS 4,120,122 A * 10/1978 Bahr ..... 52/58
4,480,941 A * 11/1984 Gilb et al.
5,058,358 A * 10/1991 Stratton ..... 52/702
5,085,389 A * 2/1992 Levesque ..... 248/300
5,513,476 A * 5/1996 Jones ..... 52/713
5,555,694 A * 9/1996 Commins ..... 52/702
5,611,179 A * 3/1997 Leek ..... 52/293.3
5,836,131 A * 11/1998 Viola et al. ..... 52/702
6,397,552 B1 * 6/2002 Bourque ..... 52/712

FOREIGN PATENT DOCUMENTS

CA 2251310 4/2002 ..... 5/12
GB 2027477 * 7/1979

* cited by examiner

*Primary Examiner*—Jerry Redman
(74) *Attorney, Agent, or Firm*—Bourque & Associates

(57) ABSTRACT

A deck attachment bracket attaching a deck to a building are provided. The attachment bracket is mountable to a concrete foundation of an existing house or other structure. The bracket includes a mounting surface for attaching the bracket to the structure, a support surface extending perpendicular to the attachment surface and at least one load transmission member interfacing the support surface to the attachment surface. The bracket further includes a deck joist retaining member attached to the support surface. The deck joist attachment member accepts a standard deck joist and allows the same to be adjustable retained therein. In one preferred embodiment, the deck joist attachment member is adjustably attached to the support member of the adjustment bracket to allow the deck joist retained in the joist retaining member to be adjustably spaced from the side of the house or other structure to account for a variety of siding materials and thicknesses.

9 Claims, 7 Drawing Sheets

DECK ATTACHMENT BRACKET AND METHOD OF ATTACHING A DECK TO A BUILDING

CROSS-REFERENCE TO RELATED APPLICATIONS

This application is a continuation of U.S. patent application Ser. No. 09/360,065 now U.S. Pat. No. 6,397,552 filed Jul. 23, 1999.

TECHNICAL FIELD

This invention relates to a deck attachment bracket and method of attaching a deck to a building. More particularly, the invention concerns a mounting bracket and attachment method, which attaches a deck to a concrete foundation of a structure.

BACKGROUND OF THE INVENTION

One of the most significant concerns in attaching a deck to a building is that there is a risk that moisture may be trapped and accumulate at the point of attachment. This could set up a situation where wood members of both the structure and deck are susceptible to rot. Accordingly, a number of prior art systems and methods have been developed to minimize the probability of trapping moisture at the point of attachment of a deck to a structure.

The most common method of, attaching a deck to a structure begins by installing a piece of roll flashing to the exterior sheathing of the structure. In new construction situations, this is preferably performed before siding is attached to the structure's sheathing. However, where a deck is to be attached to an existing structure, with attached siding, the siding should first be removed to expose the sheathing. After the roll flashing is attached to the sheathing, then a rim joist is attached over the roll flashing to the structure, preferably using lag bolts. The lag bolts will penetrate through the rim joist, flashing and sheathing and into a rim joist of the structure. Next, a window flashing is attached to the top of the attached rim joist to direct any moisture over the rim joist and away from the structure. Siding is then attached on top of the window flashing to complete the installation.

Although this form of deck installation has been used for many years, it is not completely fool proof. In fact, water has a unique way of finding its way into the sheathing and then to the rim joist. Water can weep and follow the lag bolts to the inside of the house. This can present significant problems in climates that experience severe temperature swings between the summer and winter months. During the winter months, water can work its way behind the siding and alternatively thaw and freeze in response to temperature fluctuations. This can weaken the joint between the deck and the structure.

In a typical home construction scenario, the structure is built and sided before a deck as well as other accessory devices are attached to the structure. Thus, in order to properly attach a deck to the structure using prior art methods, the siding contractor will either need to leave a portion of the structure unsided to allow the deck to be fastened thereto or attached siding must be removed in order to properly attach the deck to the structure. In either case, as can be appreciated, such an installation process adds complexity and coordination headaches to a construction project.

A number of prior patents disclose alternative methods of attaching a deck to a structure. For example, U.S. Pat. No. 4,811,542 to Jewell discloses a deck bracket, which includes a wide flange and a narrow flange spaced apart from each other by a web. The deck bracket is then easily joined to the building, preferably by screws and the deck easily bolted to the deck bracket. The deck is thus spaced away from the building so that there can be no moisture accumulation. Jewell's method of construction includes placing the deck bracket adjacent sheathing caulking it and protecting the area with siding covering it. While the Jewell bracket does separate the deck structure from a building structure and thus reduces the possibility that moisture will be trapped between the two structures, it still requires siding modifications and caulking to prevent moisture draining down the siding of the structure from accumulating and penetrating through the screw holes attaching the bracket to the structure.

U.S. Pat. No. 5,201,156 to Newman also discloses a mounting bracket, which spaces a deck or the like away from the siding of a house or other like structure in order to prevent the accumulation of water at the joint. However, like the Jewell bracket, Newman's bracket requires modifications to the exterior siding of a structure and/or caulking or the like in order to effectively waterproof the joint between the bracket and the house structure.

Accordingly, what is needed is a deck attachment bracket and method, which eliminates the joint between a deck and/or deck bracket and the exterior siding of a house or other structure, which thereby eliminates any possibility that moisture could penetrate into the wooden house or other structure. Preferably, such a bracket and attachment method should be adjustable to allow a single bracket design to be compatible with a variety of deck configurations and orientations.

SUMMARY OF THE INVENTION

According to the present invention, a deck attachment bracket and method of attaching a deck to a building are provided. The attachment bracket is mountable to a concrete foundation of an existing house or other structure. The bracket includes a mounting surface for attaching the bracket to the structure, a support surface extending perpendicular to the attachment surface and at least one load transmission member interfacing the support surface to the attachment surface.

The bracket further includes a deck joist retaining member attached to the support surface. The deck joist attachment member accepts a standard deck joist and allows the same to be adjustably retained therein.

In the preferred embodiment, a deck rim joist attachment member is adjustably attached to the support member of the adjustment bracket to allow the deck rim joist retained in the joist retaining member to be adjustably spaced from the side of the house or other structure to account for a variety of siding materials and thicknesses.

The deck attachment bracket is preferably screwed into the concrete foundation of the structure using common, prior art attachment methods, including lag screws and concrete anchors.

The attachment method includes attaching a plurality of deck attachment brackets to the concrete foundation of the house or other structure as described above, inserting a deck rim joist into a joist attachment member of each said bracket, adjustably positioning the deck rim joist in said joist attachment bracket in a desired orientation and fixing the deck rim joist thereto using fasteners, such as screws, bolts or the like. Once the deck rim joist is attached to the bracket, then the remaining steps of deck construction proceed according to prior art practices.

DESCRIPTION OF THE DRAWINGS

These and other claims of the present invention will be more fully understood by reading the following detailed description taken together with the drawings wherein:

DETAILED DESCRIPTION OF THE PREFERRED EMBODIMENTS

Figure 1A:
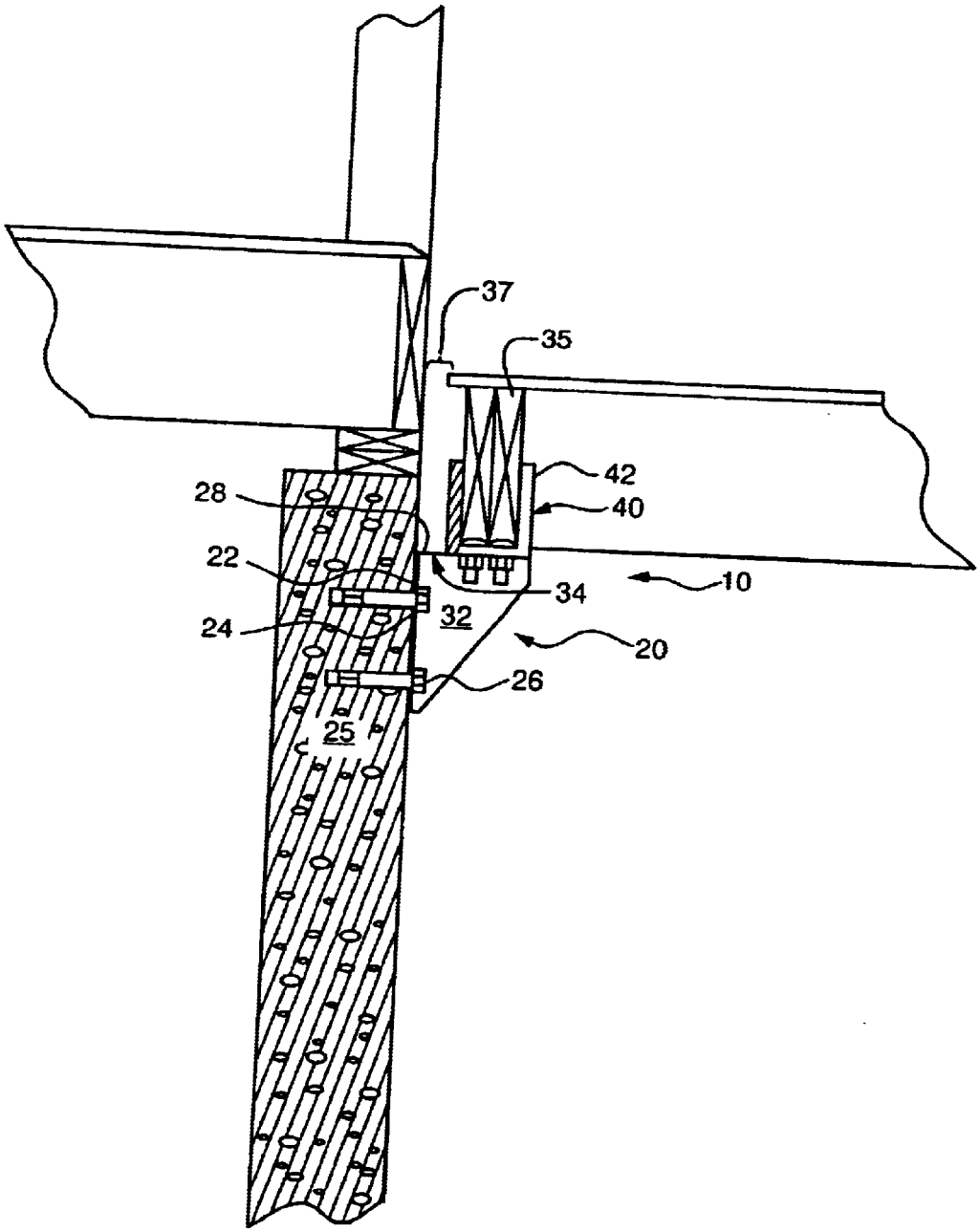
FIG. 1 is a perspective view of a first embodiment of the deck attachment bracket, showing the bracket attached to a concrete foundation of a house or other structure.
Figure 1B:
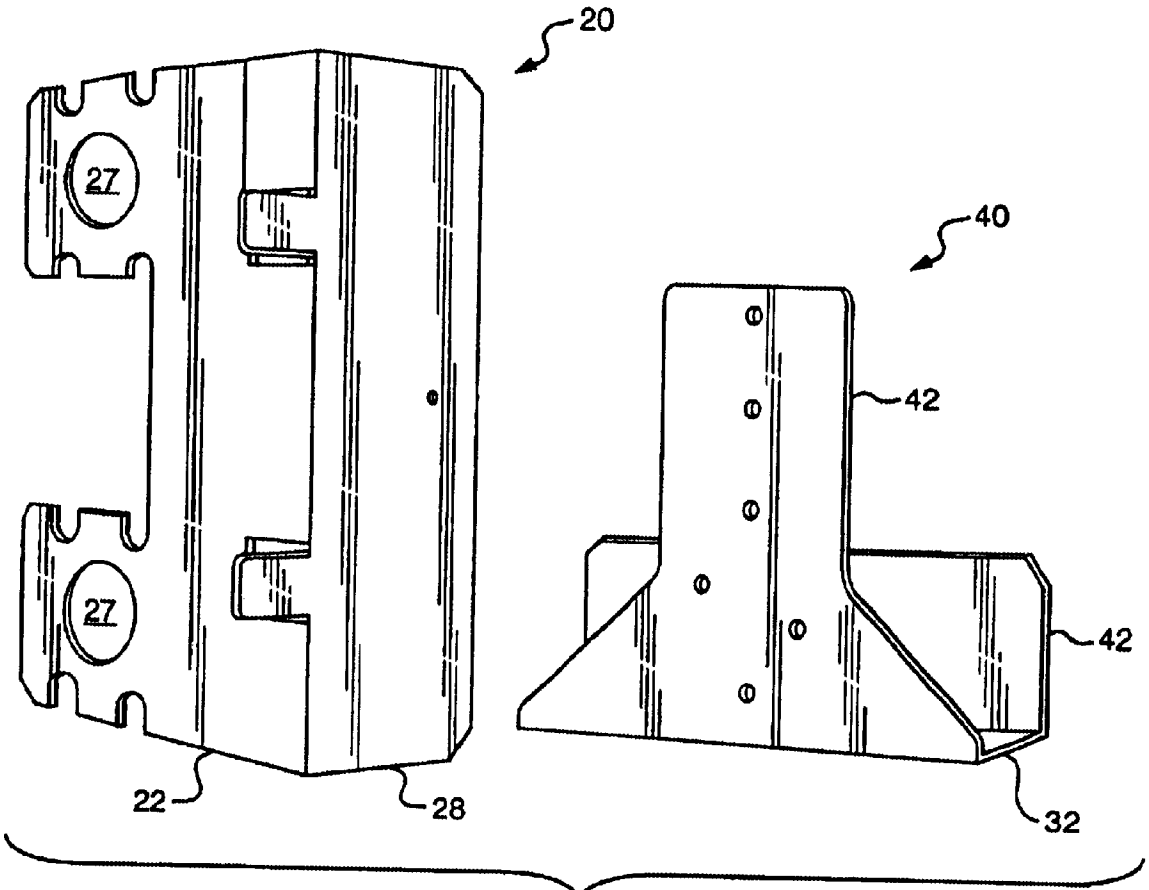
Figure 1C:
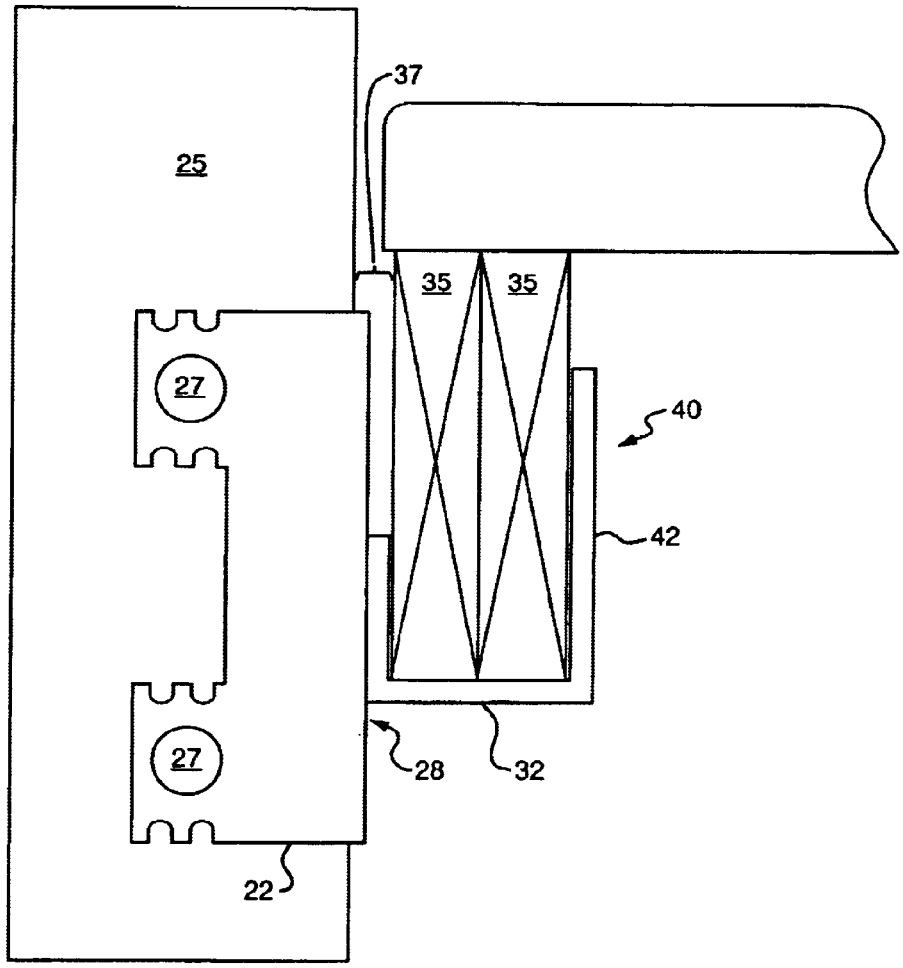
Figure 1D:
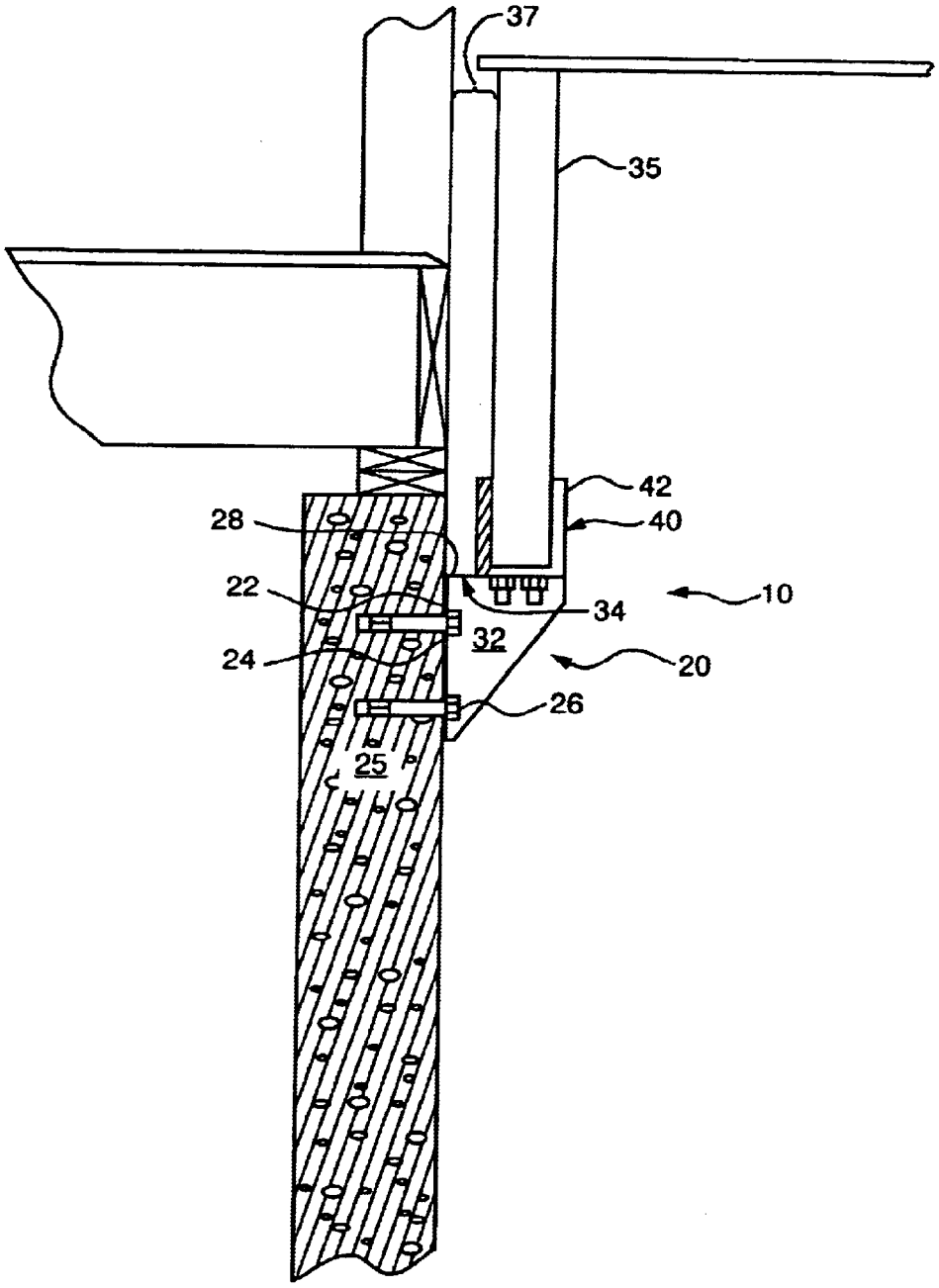
Figure 2:
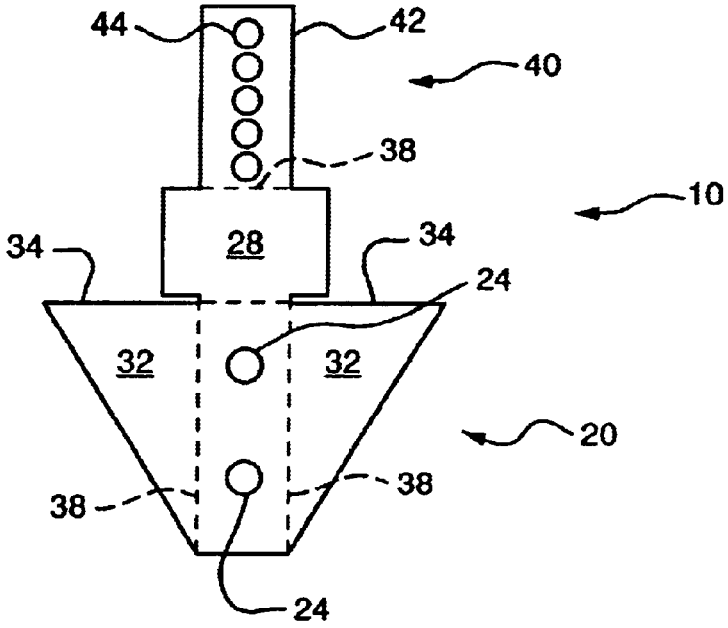
FIG. 2 is a front view of a deck bracket blank according to FIG. 1 before the bracket blank is formed by bending and tack welding the bracket plates to form the bracket.

Turning now to FIGS. 1–2, a first embodiment of a deck attachment bracket 10 according to the present invention is shown. The deck attachment bracket 10 comprises a support section 20 and a deck rim joist attachment section 40. The support section 20 includes a bracket attachment member or plate 22 that fastens or otherwise securely attaches the support section 20 to the vertical concrete foundation 25 of an existing structure or other vertical face of a structure. The bracket attachment plate 22 may be secured with a plurality of mounting holes 24 through which fasteners 26 are inserted. Alternatively, the bracket attachment member or plate 22 may be secured by molding the bracket attachment plate 22 into the concrete foundation 25 or other vertical face of a structure using, for example, but not limited to, a plurality of perforations 27 in and through which concrete flows around. Extending perpendicular from the attachment plate 22 is a support member or plate 28 and, if required, one or more load transmission members or plates 32. The support plate 28 and load transmission plate(s) 32 intersect at a substantially perpendicular junction at a top edge 34 of each load transmission plate 32, FIG. 1A.

In the preferred embodiment, the support plate 28 is welded to each load transmission plate 32 at their junctions 36 when the bracket blank is bent along bend lines 38 to form the bracket.

The rim joist attachment section 40 is comprised of at least one support attachment member or plate 42, preferably including at least one fastener hole passing therethrough to allow at least one deck rim joist or support (such as a post or stud) 35 to be fastened thereto using fasteners (not shown) common to the construction industry and held a spaced distance 37 from a vertical structure such as a concrete foundation or other structure.

The spaced distance 37 may correspond to a distance equal to the thickness of a foam or similar insulation board. The bracket 10 may be attached to a vertical structure having such an insulation board by cutting out an area from the insulation board sufficient to accommodate the bracket, or by otherwise inserting the bracket 10 through the insulation board. A plurality of fastener holes may be provided to allow a rim joist or support 35 to be fastened thereto in differing vertical positions.

Preferably, the deck attachment bracket 10 is formed from a single planar blank of material, such as sheet metal chosen to be an acceptable gauge to support the weight associated with a deck structure. Of course, alternative materials, such as molded plastics, composites, castable materials, such as metals and the like may provide suitable alternatives.

Figure 3:
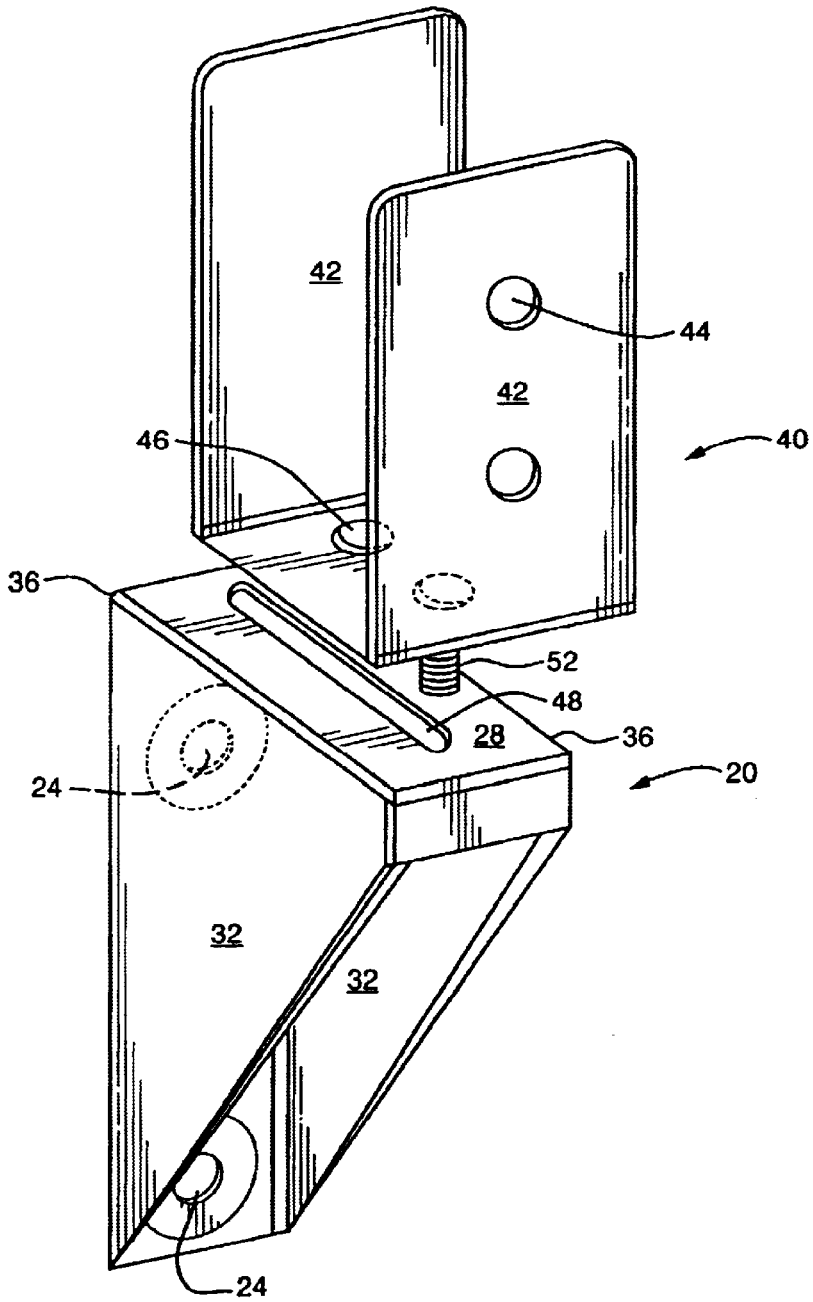
FIG. 3 is an exploded perspective view of a second embodiment of the deck attachment bracket according to the teachings of the present invention, which includes an adjustable rim joist retaining member.
Figure 4A:
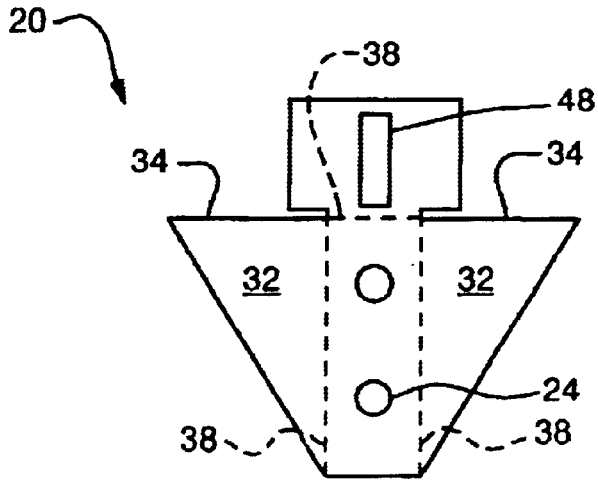
FIG. 4A is a front view of a support section blank of the adjustable bracket of FIG. 3.
Figure 4B:
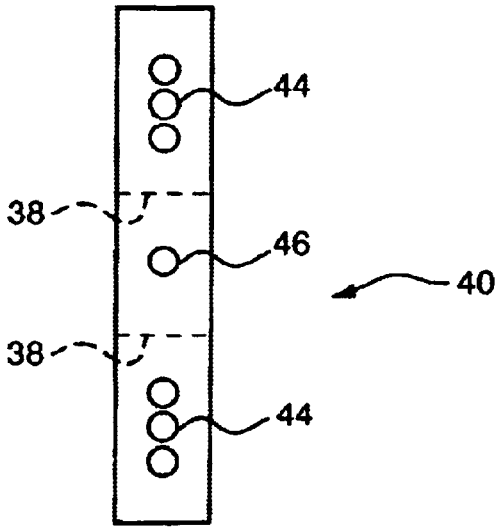
FIG. 4B is a front view of a rim joist attachment section blank of the adjustable bracket of FIG. 3.

A second embodiment of the disclosed deck attachment bracket 10 is shown in FIGS. 3 and 4. In this embodiment, the deck rim joist attachment section 40 is a separate section, which is adjustably attached to the support section 20. Preferably, the attachment is made using at least one fastener, such as the combination of nut and bolt 52, which penetrate at least one hole 46 in the rim joist attachment member 40 and hole 48 in the support plate 28 of the support section 20. In the embodiment shown, hole 48 in support plate 28 is provided in the form of a slot, thereby allowing the rim joist attachment section 40 to be slidingly adjustable in relation to the support section 20 to allow a deck rim joist or support 35 to be positioned a desired distance from a house or other structure to which a deck is attached. This would account for varying thicknesses of siding materials utilized on the structure.

Like the embodiment of FIGS. 1 and 2, the adjustable embodiment of FIGS. 3 and 4 is preferably formed from flat blanks, which are bent along bend lines 38 to form the finished shapes of the support section 20 and rim joist attachment section 40, as shown. Also like the embodiment of FIGS. 1 and 2, the support section 20 of the embodiment of FIGS. 3 and 4 may include a weld (if required) joining the support plate 28 to the load transmission plates(s) 32. As shown, the load support plate 28 may expend beyond load transmission plates 32 to facilitate the welded attachment.

Both the support section 20 and rim joist attachment section 40 further include attachment holes 24 and 44, respectively. As the embodiment of FIGS. 1 and 2, holes 24 provided in the support section 20 are utilized to secure the support section 20 to the foundation 25 of the house or other structure. Holes 44 are used, in conjunction with fasteners (not shown) to secure a deck rim joist or support 35 to the rim joist attachment member.

The adjustable embodiment of FIGS. 3 and 4 may also be formed or molded from alternative materials such as those mentioned above with respect to the embodiment of FIGS. 1 and 2.

Utilizing the deck attachment bracket 10, the disclosed invention provides a new method of attaching a deck to a house or other structure. The method begins by attaching a deck attachment bracket to a concrete foundation of the house or other structure. The bracket is designed to transmit the loads associated with a deck structure to the house foundation. Next, a deck rim joist or other member to be supported is attached to the deck attachment bracket in a manner so as to provide a desired gap between the deck and the structure. A deck or other structure is then constructed in accordance with prior art building methods.

Accordingly, a novel attachment bracket and method is provided, whereby the problems associated with moisture trapping and accumulation at the point of attachment is eliminated. The bracket and method allows a deck or other structure to be attached to a concrete foundation of a house or other structure, in a spaced relationship thereto, thereby eliminating the possibility that any moisture could penetrate the wooden structure of the house or other structure.

Modifications and Substitutions by one of ordinary skill in the art are considered to be within the scope of the present invention, which is not to be limited accept by the claims which follow.

What is claimed is:

1. A support attachment bracket for use with a building foundation having at least one face substantially perpendicular to the ground, said support attachment bracket comprising:

a support section having an attachment plate section disposed substantially perpendicular to the ground, and a support plate, coupled to said attachment plate section and disposed substantially perpendicular to said attachment plate section and parallel to said at least one face of said building foundation; and a rim joist attachment section supported by, and generally parallel with, said support plate, and including at least one rim joist attachment plate oriented parallel to and a spaced distance from said at least one face of said building foundation to which said attachment plate section will be attached, for maintaining a longitudinal face of a rim joist in a parallel and spaced relationship from said at least one face of said building foundation to which said attachment plate section will be attached.

2. The support attachment connection of claim 1 wherein said rim joist attachment section is a separate section attached to said support plate of said support section using at least one fastener penetrating at least one hole in said rim joist attachment section and at least one hole in said support section support plate.

3. The support attachment connection of claim 2 wherein said at least one hole in said support section support plate comprises a slot to allow said rim joist attachment section to be slidingly adjusted in relation to said support section along a plane parallel to said building foundation.

4. The support attachment connection of claim 1 wherein said rim joist attachment section includes at least two generally vertical legs wherein at least one of said generally vertical legs slidingly attaches to said support plate of said support section to allow said rim joist attachment section to be slidingly adjustable along said support plate along a plane parallel to said building foundation.

5. An attachment bracket for use with a support structure having at least one face substantially perpendicular to the ground, said attachment bracket comprising:

a support section having an attachment plate section mounted substantially perpendicular to the ground and a support plate disposed substantially perpendicular to said attachment plate section and parallel to said at least one face of said support structure; and a rim joist attachment section supported by, and generally parallel with, said support plate, and including at least one rim joist attachment plate oriented parallel to and a spaced distance from said at least one face of said support structure to which said attachment plate section will be attached, for maintaining a longitudinal face of a rim joist in a parallel and spaced relationship from said at least one face of said support structure to which said attachment plate section will be attached.

6. The attachment bracket of claim 5 wherein said rim joist attachment section includes a generally U-shaped rim joist attachment section.

7. The attachment bracket of claim 5 wherein said attachment section comprises a second and a third attachment plate disposed generally perpendicular to said load transmission plate, wherein said second attachment plate slidingly attaches to said support plate of said support section to allow said attachment section to be slidingly adjustable along an plane parallel to said at least one face of said support structure.

8. A bracket for attaching a support parallel to and a spaced distance from a vertical face of a structure, said bracket comprising:

a support plate disposed substantially parallel to said vertical face of said structure;

an attachment plate, disposed perpendicular with said support plate and substantially perpendicular to the ground; and a support attachment section supported by, and generally parallel with, said support plate, and including a first support attachment plate oriented parallel to and a spaced distance from said vertical face of said structure to which said attachment plate will be attached, for maintaining a longitudinal face of said support in a parallel and spaced relationship from said vertical face of said structure to which said attachment plate will be attached and at least a second support attachment plate, wherein said second support attachment plate is slidingly attached to said support plate to allow said support attachment section to be slidingly adjustable along a plane parallel to said vertical face of said structure.

9. A bracket for attaching a support parallel to and a spaced distance from a vertical face of a structure, said bracket comprising:

a support plate disposed substantially parallel to said vertical face of said structure;

an attachment plate section, disposed perpendicular with said support plate and substantially perpendicular to the ground; and a support attachment section supported by, and generally parallel with, said support plate, and including:

a first support attachment plate oriented parallel to and a spaced distance from said vertical face of said structure to which said attachment plate section will be attached, for maintaining a longitudinal face of said support in a parallel and spaced relationship from said vertical face of said structure to which said attachment plate section will be attached;

a second support attachment plate slidingly attached to said support plate to allow said support attachment section to be slidingly adjustable along a plane parallel to said vertical face of said structure; and at least a third support attachment plate disposed generally perpendicular to a load transmission plate.

* * * * *